United States Patent [19]

Lambiris

[11] Patent Number: 4,502,584

[45] Date of Patent: Mar. 5, 1985

[54] COIN CHUTE ASSEMBLY OPERABLE BY COINS DISPOSED IN A VERTICAL POSITION

[75] Inventor: Christos Lambiris, New York, N.Y.

[73] Assignee: Kidde, Inc., Saddle Brook, N.J.

[21] Appl. No.: 428,532

[22] Filed: Sep. 30, 1982

[51] Int. Cl.[3] ..... G07F 5/06

[52] U.S. Cl. ..... 194/1 G; 194/55

[58] Field of Search ..... 194/1 G, 55-60, 194/92, 93, 102, DIG. 2, DIG. 20

[56] References Cited

U.S. PATENT DOCUMENTS

| | | | |
|---|---|---|---|
| 3,430,747 | 3/1969 | Hall | 194/92 |
| 3,602,352 | 8/1971 | Robinson | 194/92 |
| 3,732,962 | 5/1973 | Hall | 194/92 |
| 3,978,960 | 9/1976 | Mellinger et al. | 194/55 |
| 4,098,385 | 7/1978 | McNally | 194/55 |
| 4,221,285 | 9/1980 | Greenwald et al. | 194/1 G |
| 4,350,240 | 9/1982 | Gitlin et al. | 194/92 |

*Primary Examiner*—F. J. Bartuska

*Attorney, Agent, or Firm*—McAulay, Fields, Fisher, Goldstein & Nissen

[57] ABSTRACT

This disclosure is directed to a coin slide assembly having a coin slide disposed for accommodating up to eight coins in a vertical position. The assembly further includes sets of inter-engaging channels and post on the assembly housing and on the coin slide, respectively, to restrict access to the internal blocking dog components of the assembly by persons intent on damaging or interferring with the normal operation of the dogs. A gate is provided through which the coins pass upon inserted movement of the coin slide. The assembly further includes a coin sizing block having inverted V-shaped notches which cooperate with the blocking dogs to render the coin slide operative only when properly sized coins are carried by the slide. A protective bar restricts the movement of the blocking dogs beyond their non-blocking position to prevent distortion of the spring which biases the dogs to their normal blocking position. The assembly further includes a baffle to push the coins down through the slots in the coin slide upon inserted movement of the slide beyond the inner end of the guide track.

23 Claims, 28 Drawing Figures

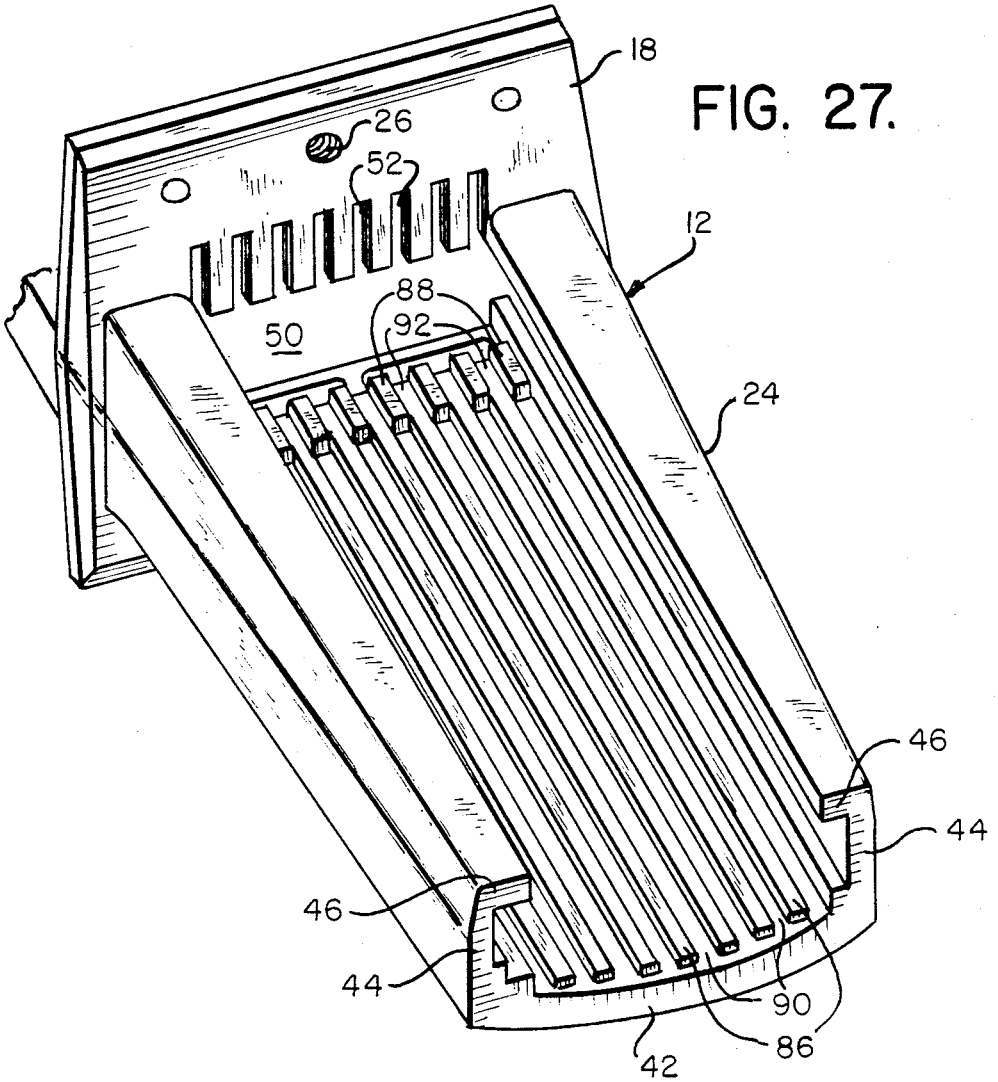
FIG. 27.
FIG. 28.
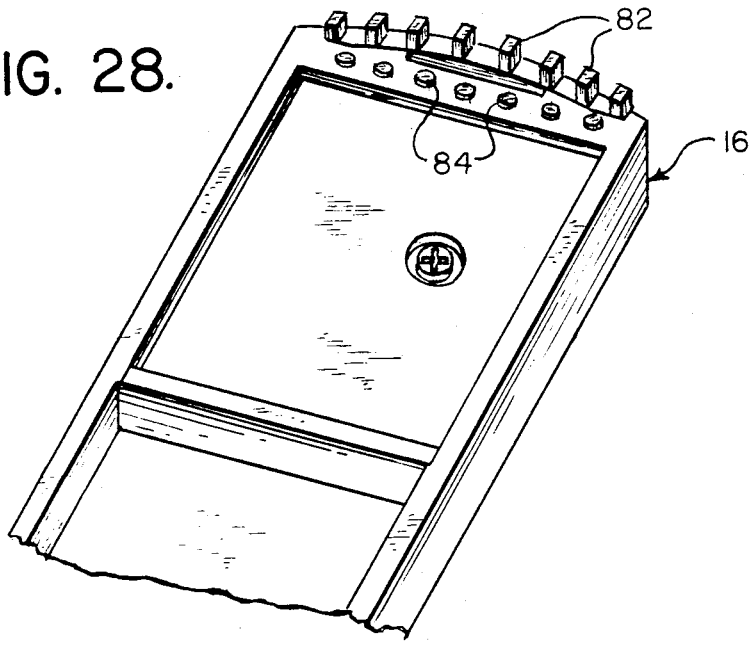

COIN CHUTE ASSEMBLY OPERABLE BY COINS DISPOSED IN A VERTICAL POSITION

BACKGROUND OF THE INVENTION

This invention is directed to a coin chute assembly in which the coin slide is provided with a plurality of coin slots adapted to receive coins disposed in a vertical or standing on edge position to permit the assembly to accommodate a greater number of coins than was heretofor possible. The assembly includes a coin sizing subassembly which cooperates with a blocking dog member to render the coin slide operative only when properly sized coins are deposited in the coin slots. The assembly further includes inter-engaging channels and posts on the assembly housing and the coin slide, respectively, to restrict access to the internal mechanism of the assembly by persons intent on tampering and/or damaging the mechanism so as to operate the coin slide either with spurious coins or with no coins at all positioned in the coin slide.

Coin chute assemblies are usually installed on commercial appliances such as clothes washers, dryers, vending machines and the like. The assembly typically is enclosed within a housing mounted on the appliance or machine. The assembly includes a coin chute having a coin slide reciprocally mounted in a guide track for inserted and retracted movement. The coin slide is formed having one or more coin receiving slots whereby the presence of an appropriately sized coin in the slot is operative to allow inward or inserted movement of the coin slide to the operate position thereof. The inner end of the coin slide is provided with an operator for actuating the appliance or machine upon continued inserted movement of the slide inwardly of the assembly to its operate position.

The housing of the assembly usually is provided with a locked coin drawer which prevents unauthorized access to a coin receptacle located below and in spaced relation to the coin slide. The arrangement is such that the coins necessary to operate the appliance or machine are carried by the coin slide upon inserted movement of the slide to its operate position whereupon the coins exit from the assembly through suitable openings thereby to be transmitted to the coin receptacle.

In the prior art, there are numerous types of coin chute assemblies which are operable by means of a plurality of coins carried by the coin slide in a flat or horizontal position. One such assembly is exemplified by U.S. Pat. No. 4,221,285 dated Sept. 9, 1980 in the name of Harry Greenwald, et al. While the aforesaid patent has proven very reliable in operation and has experienced commercial success in the marketplace, there is a practical limit as to the number of coins that can be accommodated in the coin slide when the coins are disposed in a flatwise position. In this regard, it has been found that a coin chute assembly can accommodate a greater number of coins if the assembly is designed to accept the coins in a vertical or standing on edge position. The advantage in such an arrangement is to afford the vending machine operator an increased range of prices, within limits, from which he can select the specific amount and denomination of coins necessary to operate the appliance or machine.

To this end, the prior art also includes coin chute assemblies operable by a plurality of coins disposed in a vertical or standing on edge position. These references are exemplified by U.S. Pat. No. 3,712,440 dated Jan. 23, 1973 also in the name of Harry Greenwald, and U.S. Pat. No. 3,732,962 dated May 15, 1973 in the name of Mitchell A. Hall. Applicants also are aware of commercially available coin chute assemblies manufactured by The Maytag Company, Newton, Iowa, and by Equipment System and Devices, Inc. Philadelphia, Pa., each operable by a plurality of coins disposed in a vertical position. However, each of these known assemblies suffer from the limitation of being able to accommodate only three or five coins thereby limiting the maximum amount or dollar evaluation of the coins necessary to operate the appliance or machine. For example, in the case where the coin slide can receive only five coins all of which are quarters, the maximum dollar amount that can be selected by the vending machine operator to operate the appliance or machine is $1.25.

Furthermore, the known coin chute assemblies heretofor available for accepting coins in a vertical position are not entirely effective in preventing tampering with or destruction of the internal coin chute mechanism. The present invention represents a considerable improvement over the heretofor known assemblies both in terms of versatility and mode of operation, as well as in simplicity of construction. The present invention also includes an improved coin sizing subassembly to insure that only properly sized coins are used to operate the appliance or machine.

SUMMARY

The improved coin slide assembly of this invention enables the coin slide to receive up to eight coins in a vertical position. The guide track in which the coin slide is disposed for reciprocal movement is formed having a first set of rails and a second set of rails. The second set of rails is positioned inward of the first set of rails, and the members of the first and second set of rails are parallel one another. The second set of rails also is laterally and longitudinally offset with respect to members of the first set of rails. That is, the members of the second set rails project upwardly to a greater extent than members of the first set of rails.

The first set of rails define a first set of channels and the second set of rails define a second set of channels. The second set of channels is positioned inward of the first set of channels, and the members of the first and second set of channels also are parallel to one another. Furthermore, the second set of channels also is laterally and longitudinally offset with respect to members of the first set of channels. That is, the members of the second set of channels project upwardly to a greater extent than members of the first set of channels.

Furthermore, each one of the first channels is aligned with a separate one of the second rails, and each one of the first rails is aligned with a separate one of the second channels. The arrangement is such that the plane defined by the upper surface of the second channels is substantially co-planar with the plane defined by the upper surface of the first rails.

The coin slide is formed having a first set of posts and a second set of posts. The second set of posts is positioned inward from members of the first set of posts. Both sets of posts project downwardly from the undersurface of the slide. The first set of posts project downwardly to a greater extent than the second set of posts. Furthermore, the second set of posts is positioned to be laterally and longitudinally offset with respect to members of the first set of posts.

When the coin slide is mounted in the guide track, the first set of posts engage and ride in the first set of channels while the second set of posts rides on the first set of rails. At such time as the coin slide is fully inserted, the second set of posts will ride in the second set of channels. The coin slots in the slide are aligned over the first set of channels when the coin slide is in its retracted position. The arrangement is such that movement of the coin slide in the guide track from a retracted position to an inserted position will cause a properly sized coin carried by the slide to first ride in a corresponding one of the first channels and then ride on a corresponding one of the second rails.

The aforesaid inter-engagement of the posts and channels serves to prevent the insertion of a shim or other tool along the bottom of the slide by a person intent on tampering with or destroying the internal blocking dog components of the assembly to obtain free play.

The coins pass through a mounting plate, which in combination with a slidable plate, define a gate having an open position and a closed position. After the coin passes through the gate in its open position, the inter-engagement of the slide with the moveable plate serves to close the gate upon continued inserted movement of the slide.

A sizing block is fixed in position above the guide track and is provided with a plurality of inverted V-shaped notches. The notches are aligned with the slots in the coin slide. There also is provided a plurality of pivotally mounted blocking dogs along the guide trace.

Each dog is aligned with a separate one of the coin slots and with a separate one of the notches in the sizing block. The dogs are biased into a normal blocking position in the path of travel of the slide, and are disposed for movement from their blocking position to a displaced non-blocking position. The arrangement is such that inserted movement of the coin slide causes a properly sized coin to ride onto the corresponding blocking dog with the upper edge of the coin received in and engaging the corresponding notch in the sizing block. The spacing between the notch and the dog is such as to cause the engaged coin to press down against the corresponding dog and move said dog to its displaced non-blocking position. Failure to move all of the dogs to their non-blocking position will prevent the full insertion of the coin slide.

The invention further includes a protective bar positioned in the path of movement of the blocking dogs to restrict further displaced movement beyond their non-blocking position, and thereby prevents distortion of the spring which biases the dogs to their normal blocking position.

The assembly further includes a downwardly curved baffle positioned in the guide track inward of the sizing block. The baffle is positioned to engage the edges of the coins carried by the coin slide to push the coins down through the respective slots in the slide as the slots pass the inner end of the guide track whereupon the coins leave the assembly and enter the coin box.

For a better understanding of the invention, and its various features and advantages, reference should be made to the following detailed description when taken in conjunction with the accompanying drawings.

BRIEF DESCRIPTION OF THE DRAWINGS

FIG. 27 is a partial perspective view of the coin chute housing of FIG. 5 showing the plurality of longitudinally extending rails and channels; and FIG. 28 is a partial perspective view of the bottom surface of the coin slide of FIG. 9 showing the plurality of first and second sets of posts which operatively cooperate with the rails and channels of the coin chute housing, when assembled together, to prevent tampering with the internal coin chute mechanism.

DESCRIPTION OF THE PREFERRED EMBODIMENTS

Figure 1:
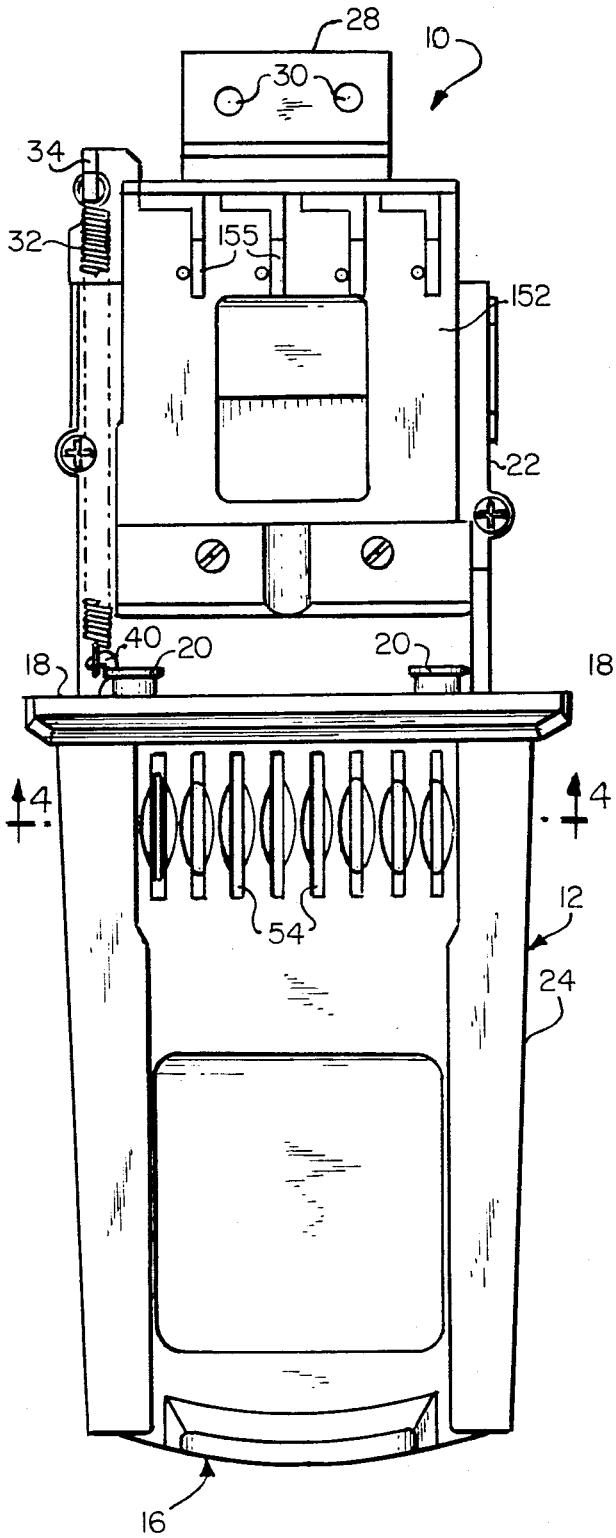
FIG. 1 is a top plan view of a coin chute assembly embodying the present invention, with the coin slide retracted ready to receive coins of a selected denomination; and with some of the coin slots fitted with a blank insert to inactivate the blanked slot.

Referring to the drawings, and more particularly to FIGS. 1, 2, 5 and 8, there is shown a coin chute assembly represented generally by numeral 10 constructed in accordance with the present invention. Assembly 10 includes a housing 12 provided with a guide track 14 reciprocably supporting a coin slide 16 for inserted and retracted movement within said housing. Assembly 10 is adapted to be mounted on a housing (not shown) which, in turn, is mounted on a commercial appliance such as a clothes washer, dryer, vending machine and the like. To this end, housing 12 has a mounting plate subassembly 18 formed with a plurality of mounting lugs 20 adapted to be received in suitable openings in the wall of the housing that is mounted to the commercial appliance to support the coin chute assembly 10 firmly in place. The housing wall which receives mounting lugs 20 also is provided with an enlarged opening through which the inner portion 22 of housing 12 passes when assembly 10 is mounted in place. In this regard, mounting plate 18 may be regarded as a partition separating the inner portion 22 from an outer portion 24. A threaded opening 26 is formed in plate 18 which is adapted to receive the threaded end of a mounting bolt (not shown) which further serves to secure assembly 10 in place. The bolt engages plate 18 from the inner or back surface of said plate.

As will become apparent from a more detailed description of coin slide 16, the slide is adapted to carry a plurality of coins in a vertical or standing on edge position inwardly of housing 12 upon inserted movement of said slide 16 to its operate position whereupon the coins are transmitted to a coin receptacle (not shown) positioned within the housing that is mounted to the commercial appliance. Access to the coin receptacle is gained through a locked coin drawer suitably located in said latter housing whereby said coin drawer may be unlocked and the contents of the coin receptacle removed at periodic intervals. The coin slide 16 is usually provided with an operator (not shown) mounted on the inner end portion 28 thereof, by means of threaded openings 30, for actuating the appliance or machine upon advanced or inserted movement of said slide. The coin slide 16 is retracted back to its coin receiving position by a spring 32 having one end connected to a post 34 of a bracket 36 which is mounted to the bottom surface of coin slide 16 by means of threaded fasteners 38. Bracket 36 is mounted to coin slide 16 adjacent the inner end of said slide. The other end of spring 32 is connected to a hook 40 mounted to the inner surface of mounting plate 18.

Referring to FIGS. 5, 6, 7 and 27, the outer portion 24 of housing 12 is channel-shaped having a base platform 42 and a pair of side members 44 projecting upwardly from opposite sides of said base. Side members 44 have inturned ends 46 which are disposed in facing relation to each other. The overall arrangement is such that base 42, side members 44 and inturned ends 46 collectively define an elongated channel which serves as the outer portion of the guide track 14 in which coin slide 16 is supported for reciprocal movement. In this sense, the outer portion of guide track 14 is defined as that portion formed by the outer portion 24 of housing 12. The guide track also extends inwardly of mounting plate 18 and is thus defined as having an inner portion formed by the inner portion 22 of housing 12. The bottom surface of base 42 is formed having a strengthening rib 48 which extends from said base to a lower central region of mounting plate 18.

Figure 7:
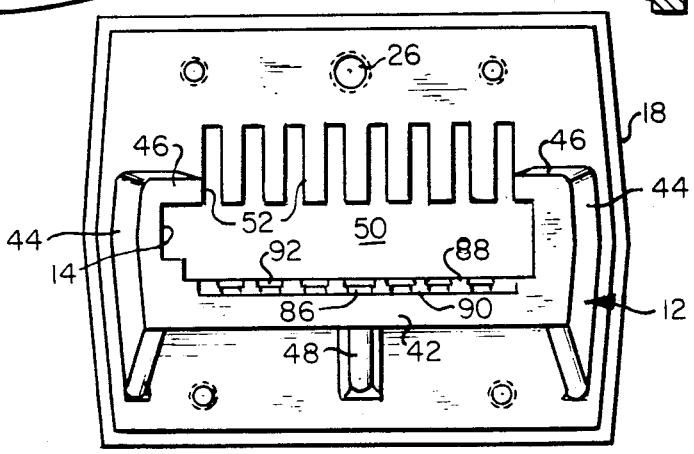
FIG. 7 is a front elevational view of the coin chute housing of FIG. 5 up to the mounting plate thereof.

As shown in FIGS. 7 and 27, mounting plate 18 is provided with a substantially centrally located opening 50 through which passes the coin carrying portion of coin slide 16. Plate 18 further is formed having a plurality of open ended slots 52 disposed vertically and in parallel relation to one another. The open ends of slots 52 communicate with central opening 50 and are disposed to permit passage of a plurality of coins carried by coin slide 16 in a vertical or standing on edge position upon inserted movement of the coin slide, in the manner to be hereinafter described, whereby the coins pass through plate 18 and are carried to the coin sizing mechanism of the assembly.

Figure 8:
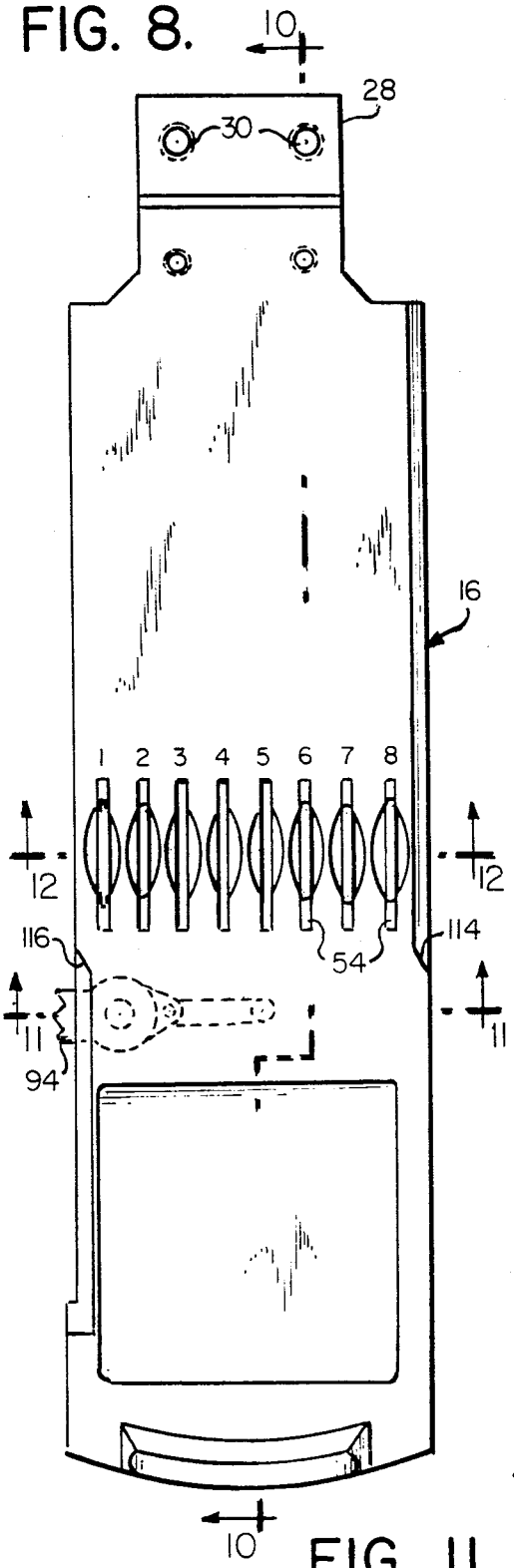
FIG. 8 is a top plan view of the coin slide of FIG. 1 removed from the coin chute assembly.

Referring to FIGS. 1 and 8, coin slide 16 is formed having a plurality of coin support slots 54 each adapted to hold a coin 56 placed therein in a vertical plane. The arrangement is such that each of the slots 52 in plate 18 is aligned with a separate one of the coin support slots 54 in coin slide 16 when said slide is mounted in guide track 14 for reciprocal movement therein.

As previously indicated, one of the features of this invention is to enable the vending machine operator to select the specific amount and denomination of coins, within limits, necessary to operate the appliance or machine. In the present embodiment, coin slide 16 has eight of such slots 54 each sized to accommodate a 25 cent coin. The operator thus can require the user to deposit a maximum of eight quarters totalling $2.00 to operate the appliance. However, there is provision for blanking out one or more of the coin support slots 54 to reduce the number of coins necessary to operate the mechanism. In this regard, for purposes of illustration, four of the slots 54 designated by numbers 2,6,7, and 8 in FIG. 8, are shown as being blanked out. Furthermore, the operator also has the option of reducing the size of some of the slot openings, namely those slots designated by numbers 1 and 2, so as to accommodate a ten cent coin. This is illustrated in the drawings with reference to the coin slot designated by numeral 1. With this arrangement, the operator has a wide range of prices between ten cents and two dollars which he can select to operate the mechanism. The manner of blanking out selected ones of said coin slots 54 and/or reducing the size of the opening thereof will be hereinafter described.

Figure 23:
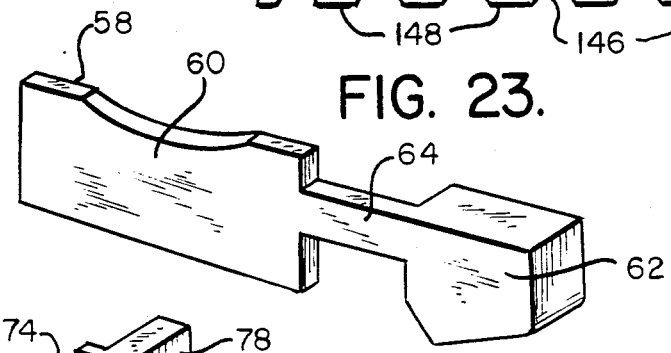
FIG. 23 is a perspective view of the blank insert adapted to be positioned in the coin slide to inactivate a selected coin slot, and which insert includes a nose portion adapted to move the associated blocking dog to its non-blocking position upon inserted movement of the coin slide.
Figure 23:
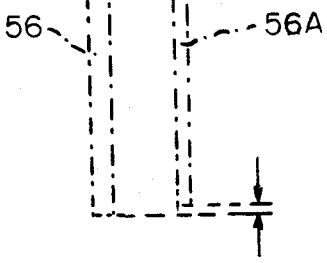

The manner of rendering any one coin support slot 54 inoperable is to insert a blank member 58 in said slot in place of a coin. Blank 58 is shown in FIG. 23 and includes a seat portion 60 and a nose portion 62 interconnected by a neck portion 64. Blank 58 is inserted in place through the bottom surface of coin slide 16. More specifically, referring to FIGS. 9, 10 and 12, a bottom plate 66 overlies that portion of coin slide 16 having the coin support slots 54, and is secured in place by fastener 68. Plate 66 is formed having a plurality of slots 70 equal in number and size to coin support slots 54. Each of the slots 70 in plate 66 is aligned with a separate one of the slots 54 in coin slide 16 so that a properly sized coin 56 positioned in a pair of aligned slots 54, 70 will pass therethrough.

With plate 66 removed from the coin slide 16, a blank 58 may be inserted in place with the seat portion 60 received in any one of the coin support slots 54. The seat portion is positioned with its top concave shaped surface facing upward as viewed in FIG. 10. The thickness of seat portion 60 is slightly less than the thickness of the corresponding slot 54 in which it is received. The inner end of plate 66 has an upward projection 72 which is received in the space between seat portion 60 and nose portion 62, and which engages neck portion 64 to firmly hold blank 58 position when the plate is fastened in place. In such arrangement, the camming edge of nose portion 62, which is considerably thicker than seat portion 60, is exposed for engaging with a blocking dog as noted more fully in a later part of this specification.

Figure 24:
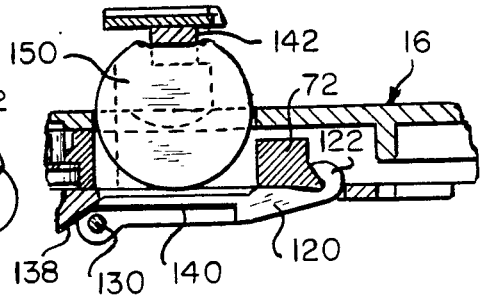
FIG. 24 is a perspective view of an adaptor operable to reduce the size of the coin slot in the coin slide to receive a dime.

The manner of reducing the size of a selected coin support slot 54 is to insert an adaptor 74 in said slot. Adaptor 74 is shown in FIG. 24 and includes a seat portion 76 and a pair of legs 78 projecting downwardly from the opposite ends of said seat. A slot 80 is formed in seat portion 76 which is sized to accomodate a dime. Adaptor 74 also is inserted in place through the bottom surface of coin slide 16 when bottom plate 66 is removed.

Figure 12:
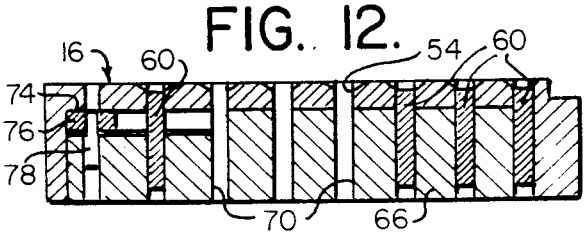
FIG. 12 is a cross-sectional view taken along line 12—12 of FIG. 8.

In the present embodiment, adaptor 74 is shown as being inserted in the coin support slot designated by number 1, which corresponds to the left-most positioned slot shown in FIG. 8 The width of seat 76 is such as to define shoulder portions which bear against the bottom surface of coin slide 16, as shown in FIG. 12, whereupon cover plate 66 retains said adaptor 74 in place.

Figure 9:
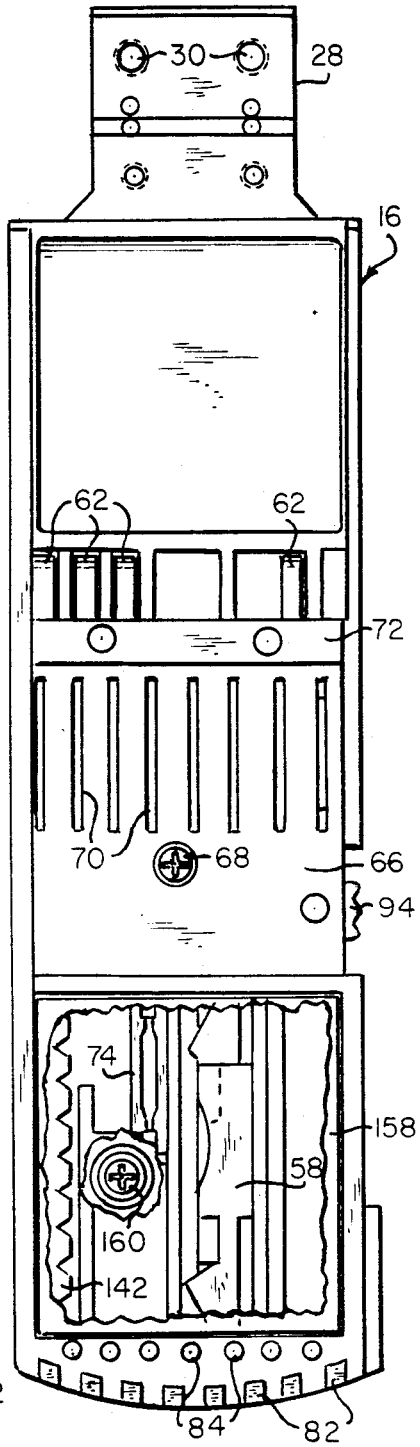
FIG. 9 is a bottom plan view of the coin slide of FIG. 8, with parts broken away, showing a storage compartment for spare parts.
Figure 11:
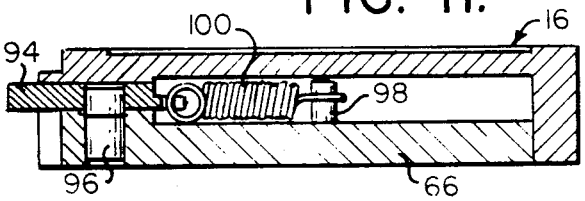
FIG. 11 is a cross-sectional view taken along line 11—11 of FIG. 8.

In accordance with another feature of the invention, inter-engaging members are provided on housing 12 and coin slide 16 to restrict access to the internal mechanism of the assembly 10. Referring to FIGS. 9 and 28, the members on coin slide 16 which serve this function are defined as a first set of posts 82 which extend downwardly from the under surface of coin slide 16 adjacent its outer end, and a second set of posts 84 positioned inward from members of posts 82. As noted in the drawings, posts 82 extend or project downwardly a greater distance than posts 84. In other words, if we consider the end surfaces of posts 82 and posts 84 as defining separate planes, then the plane defined by the end surfaces of posts 82 lies below the plane defined by the end surfaces of posts 84 when coin slide 16 is mounted in guide track 14. Furthermore, posts 84 are positioned so as to be laterally and longitudinally offset with respect to posts 82. The purpose of this arrangement will become apparent from a discussion of the corresponding members of housing 12 with which said posts 82, 84 interengage.

Figure 5:
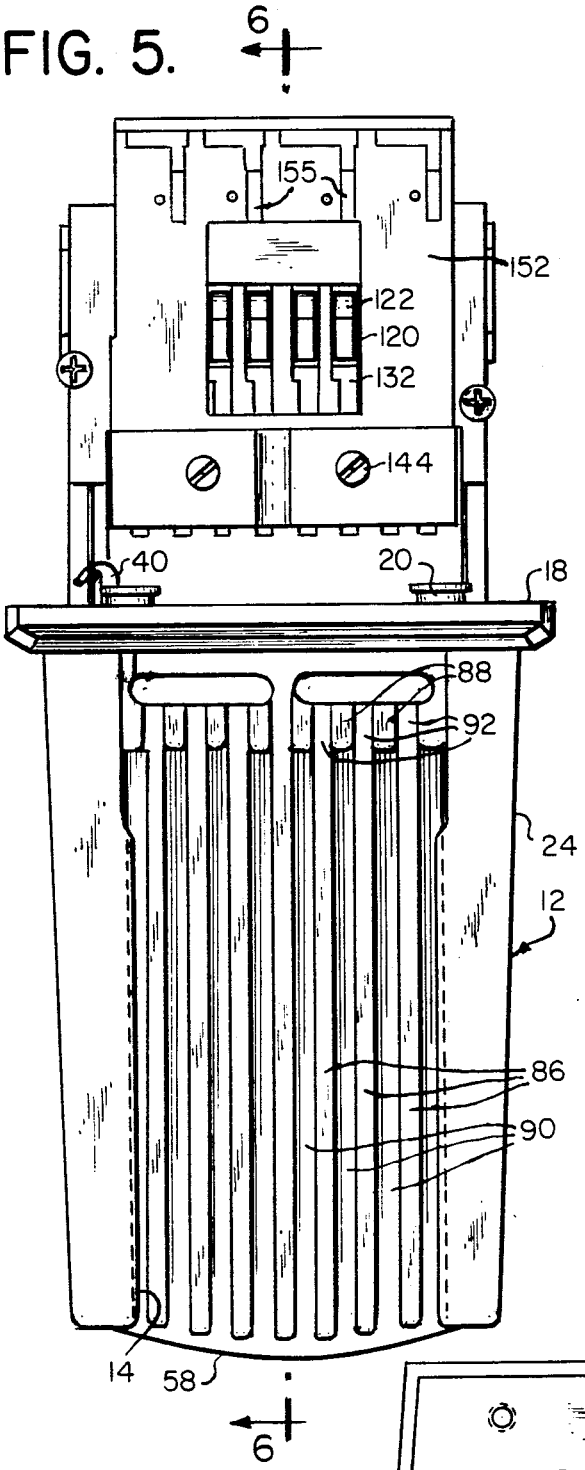
FIG. 5 is a top plan view of the coin chute housing of FIG. 1, with the coin slide removed, showing the plurality of longitudinally extending rails and channels which cooperate to prevent the insertion of a shim in the space between said coin chute housing and the coin slide, when assembled together, thereby to prevent tampering with the internal coin chute mechanism.

Referring to FIGS. 5,7 and 27, the members on housing 12 which inter-engage with posts 82, 84 are defined as a plurality or first set of longitudinally extending rails 86 projecting upwardly from the upper surface of base section 42, and a plurality or second set of longitudinally extending rails 88 positioned inward from members of rails 86. Members of said first set of rails 86 are substantially parallel to one another, and members of said second set of rails 88 also are substantially parallel to one another. The arrangement is such that members of said first set of rails 86 also are substantially parallel to members of said second set of rails 88. As noted in the drawings, members of rails 88 are positioned so as to be laterally and longitudinally offset with respect to members of rails 86. In this arrangement, rails 88 project above base platform 42 to a greater extent than rails 86.

Rails 86 define a plurality or first set of longitudinally extending channels 90, and rails 88 define a plurality or second set of longitudinally extending channels 92. As is apparent from the drawings, members of said first set of channels 90 and said second set of channels 92 are substantially parallel to one another. Furthermore, members of channels 90 are laterally and longitudinally offset with respect to members of channels 92. The arrangement is such that channels 92 project above base platform 42 to a greater extent than channels 90.

In considering the relationship of rails 86, 88 and channels 90, 92 from another perspective, members of rails 88 may be considered as extending longitudinally inward from a lateral plane defined by the inner ends of members of rails 86. Furthermore, if we consider the upper surfaces of rails 86 and rails 88 as defining separate planes, then the plane defined by the upper surface of rails 88 lies above the plane defined by the upper surface of rails 86. Still further, the plane defined by the upper surface of channels 92 lies above the plane defined by the upper surface of channels 90. The arrangement is such that the plane defined by the upper surface of channels 92 is substantially co-planar with the plane defined by the upper surface of rails 86.

As further noted, each of the slots 52 in mounting plate 18 is aligned over a separate one of the channels 90. Furthermore, since each one of the channels 90 is aligned with a separate one of the rails 88, the slots 52 in plate 18 also are aligned with corresponding ones of said rails 88.

When coin slide 16 is mounted in guide track 14 for reciprocal movement, posts 82 inter-engage and ride in channels 90. Continued inserted movement of coin slide 16 will cause one or more of posts 82 to abut against the outer ends of the correspondingly aligned rails 88 to determine the fully inserted position of said slide. During such insert movement of coin slide 16, the shorter set of posts 84 first ride over respective members of rails 86, and then ride in the correspondingly aligned members of channels 92 when said coin slide 16 is in its fully inserted position. The position of coin support slots 54 when coin slide 16 is in place is to locate each of said slots 54 aligned over a separate one of said channels 90. The arrangement is such that movement of coin slide 16 in guide track 14 from a retracted position to an inserted position will cause a properly sized coin in any one of coin support slots 54 to first ride in a corresponding one of said channels 90 and then ride on a corresponding one of said rails 88.

It now becomes apparent that the inter-engagement of posts 82, 84 with the rails 86, 88 and channels 90, 92 serve to restrict access to the internal mechanism of apparatus 10 inward of mounting plate 18. More specifically, the aforesaid inter-engagement of said members will prevent the insertion of a shim along the bottom of coin slide 16 by a person intent on tampering with or destroying the blocking dog components of the assembly, as hereinafter described, thereby to advance coin slide 16 to its fully inserted position without the presence of any coins in coin support slots 54. Any attempt to use such a shim for the purpose of committing acts of vandalism will be blocked by the raised set of rails 88 as well as by the inter-engagement of said members.

As is well known in the art, the assembly 10 provides a ratchet mechanism to prevent retracted movement of coin slide 16 after it has been inserted a predetermined distance. The mechanism permits retraction of coin slide 16 only after it has been moved to its fully inserted position to deposit the coins in the coin box (not shown). As can be seen in FIGS. 8–11, the rachet mechanism includes a pawal 94 carried on coin slide 16 by a post 96 in engagement with cover plate 66. The operative end of pawl 94 projects laterally beyond a side edge of the slide. The opposite end of pawl 94 is connected to another post 98 on plate 66 by a spring 100. The arrangement permits pawl 94 to rotate or pivot about post 96 against the influence of spring 100. The mechanism is first assembled to the inner surface of plate 66 whereupon the plate is then secured in place to coin slide 16.

Figure 6:
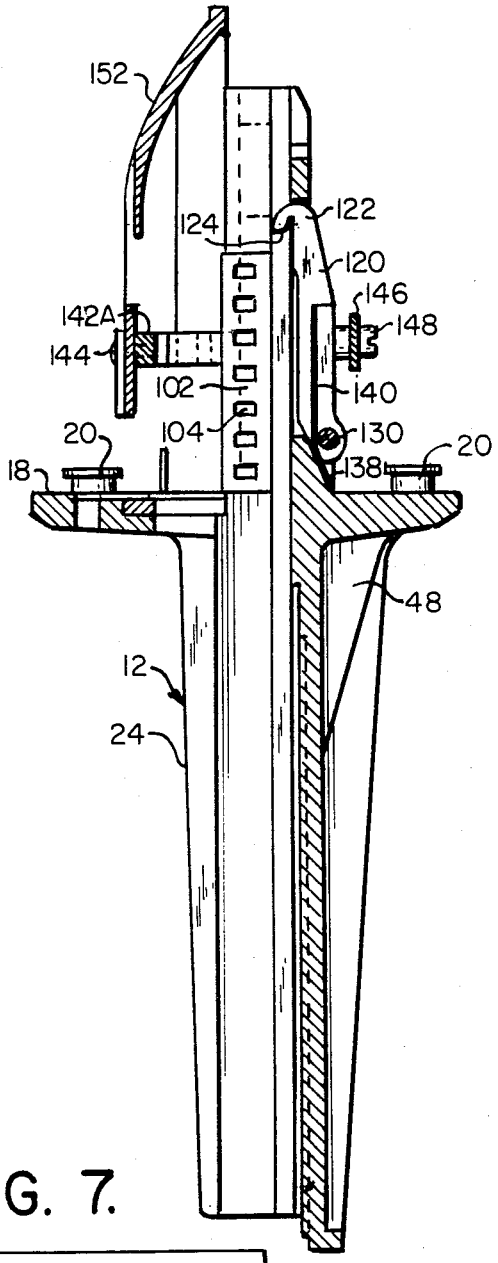
FIG. 6 is a longitudinal sectional view taken along line 6—6 of FIG. 5.

Pawl 94 coacts with a rack 102 mounted to or formed along a side wall of guide track 14 inward of mounting plate 18 as shown in FIG. 6. Rack 102 is formed having a plurality of notches 104 in the form of rectangular-shaped cut-outs. In operation, when the coin slide 16 is pushed toward its fully inserted position, the pawl engages the rack 102 and pivots in a counter-clockwise direction, against the action of spring 100. This causes the pawl 94 to ride along the rack 102 with its tooth-shaped edge facing generally outwardly in the direction toward the finger gripping portion of the slide. As can readily be realized, once the pawl 94 rides into the first notch 104, any attempt to pull the slide 16 in its retracted position will be prevented by the jamming effect of the tooth-shaped edge into said notch. Once the pawl 94 rides past the rack 102, when slide 16 is in its fully inserted position, pawl 94 is biased back to a neutral position from which it is pivoted now in a clockwise direction, against the action of spring 100, upon reverse engagement with the rack 102 during movement of the slide to its retracted position. The tooth-shaped edge of pawl 94 now faces inwardly and rides over the notches 104 of rack 102 to permit retracted movement of slide 16. However, now the engagement and jamming effect of the pawl 94 with the notched rack 102 is such to prevent inserted movement of the slide 16 until after the slide is fully retracted to receive additional coins.

Figure 20:
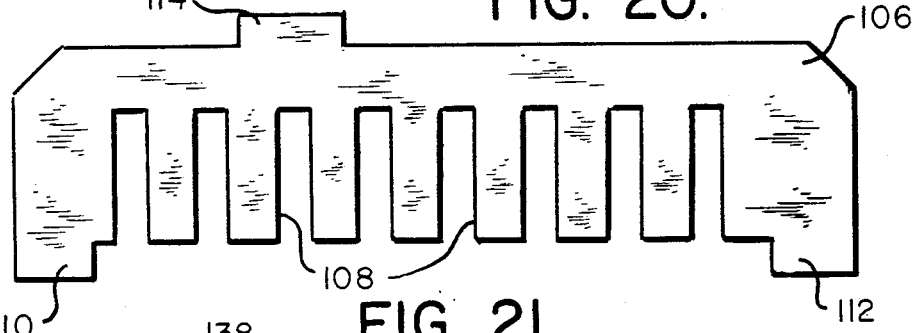
FIG. 20 is a front elevational view of the gate member removed from the coin chute housing.

As previously indicated, inserted movement of coin slide 16 carries the appropriated sized coins positioned in coin slots 54 through the correspondingly aligned slots 52 in mounting plate 18 to the internal sizing mechanism of the apparatus. Once again, in order to prevent insertion of a tool through said slots 52 by a person intent on tampering with or destroying the blocking dog components of the assembly, another safety feature is provided in the form of another plate 106 positioned above guide track 14 and disposed for reciprocal movement laterally of the inner surface of mounting plate 18. Referring to FIG. 20, plate 106 is formed having a plurality of vertical slots 108 equal in number to the slots 52 of mounting plate 18. Plate 106 also is formed having a pair of lugs 110 and 112 projecting downwardly from the opposite ends of the plate, and also includes another lug 114 projecting upwardly from the upper surface. Lugs 110 and 112 cooperate with edge portions of coin slide 16 for slidably moving plate 106 upon reciprocal movement of the coin slide in the manner hereinafter described. Lug 114 serves as a guide to insure that plate 106 is correctly positioned in place along the inner surface of plate 18.

Figure 17:
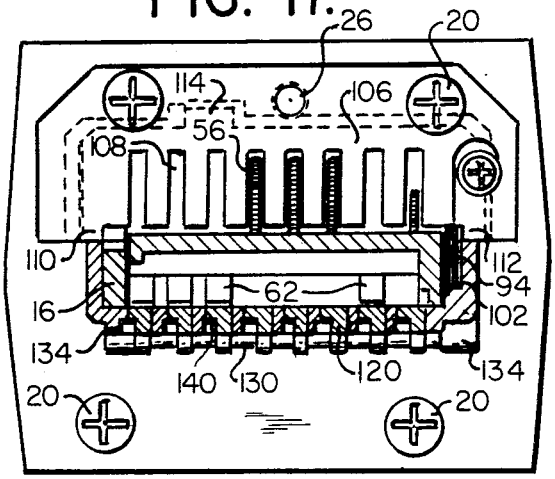
FIG. 17 is a cross-sectional view taken along line 17—17 of FIG. 13, showing the gate in its open position.
Figure 18:
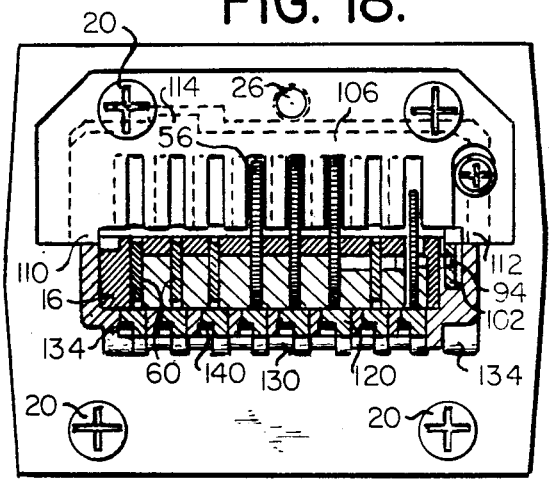
FIG. 18 is a cross-sectional view taken along line 18—18 of FIG. 14, showing the gate in its closed position.

The mounting of movable plate 106 to the inner surface of plate 18 is shown in FIGS. 17 and 18. The inner surface of plate 18 has a recessed portion sized to accommodate 106 for reciprocal movement laterally of plate 18. Plate 106 is retained in its slidably mounted position by a suitable closure member. The cooperative arrangement of plates 18 and 106 is such to define a gate having an open position and a closed position. More specifically, plate 106 is disposed for slidable movement between a first position shown in FIG. 17 and a second position shown in FIG. 18. When plate 106 is in its first position, each of the slots 108 therein is aligned with a separate one of the slots 52 in plate 18 to define the open position of the gate. When plate 106 is in its second position, each of the slots 108 is laterally offset from the corresponding slot 52 in plate 18 to define the closed position of the gate. It should now be apparent that when the gate is in its open position, an appropriately sized coin 56 positioned in any one of the coin slots 54 of coin slide 16 will be permitted to pass through the correspondingly aligned slots 52 and 108 in plates 18 and 106, respectively, upon inserted movement of the slide. Conversely, when the gate is in its closed position, it no longer is possible to insert a foreign object through any one of the slots 52 in plate 18 in an effort to manipulate the coins 56 or the internal mechanism of the apparatus.

Movement of plate 106 between its first position and second position is effected by camming edge surfaces 114 and 116 of coin slide 16, as shown in FIG. 8. In this regard, when coin slide 16 is in its retracted position to receive coins 56, plate 106 is in its first position and the gate is open. However, after the coin 56 passes mounting plate 18 during inserted movement of coin slide 16, the camming edge 114 engages the left-sided lug 110 of plate 106, as viewed in FIG. 17, to slidably move plate 106 to its second position, as viewed in FIG. 18, to close the gate. Plate 106 is moved back to its first position upon retracted movement of coin slide 16 by means of camming edge 116 engaging the right-sided lug 112 of plate 106 thereby rendering the gate open.

Figure 25:
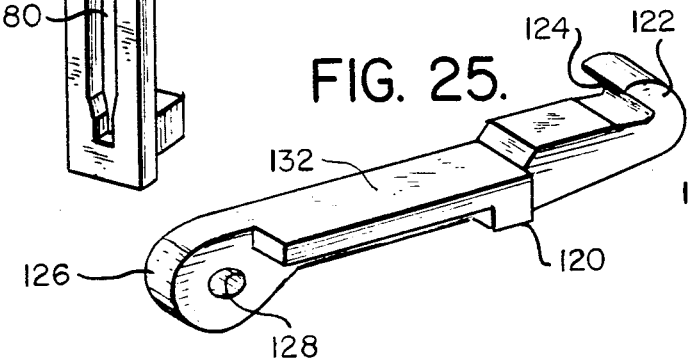
FIG. 25 is a perspective view of a blocking dog removed from the coin chute housing.

In order to prevent full insertion of coin slide 16 when it is not carrying any coins or when the slide is carrying improperly sized coins, a set of blocking dogs 120, such as shown in FIG. 25, is pivotally mounted to the undersurface of housing inner portion 22 each having a hook-shaped end portion 122 disposed along guide track 14. The hook end is formed having a shoulder surface 124 which functions as a stop against which an undersurface edge of coin slide 16 abuts when the slide is moved in its inserted direction thereby to limit the extent to which the slide may be inserted without a proper coin 56 in coin support slot 54. The opposite end 126 of blocking dog 120 is provided with an opening 128 sized to loosely receive a pivot pin 130 about which dog 120 rotates. Intermediate the hook end 122 and the pivotally mounted end 126 is a platform section 132 which defines the upper surface of dog 120. Platform 132 is disposed to lie along the path of travel of a coin 56 upon inserted movement of coin slide 16 as hereinafter described.

Figure 26:
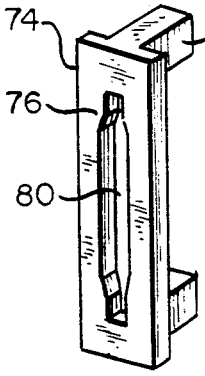
FIG. 26 is a partial sectional view similar to FIG. 15, but showing a spurious coin simulating element positioned in engagement with the coin sizing block, and showing the blocking dog in its normally biased blocking position in engagement with the coin slide to prevent continued inward movement of the slide to its inserted position.

Referring to FIGS. 13–18, the blocking dogs 120 are pivotally mounted about the pin 130 suitably supported between a pair of support brackets 134. In the illustrated form of the invention, each of the blocking dogs is aligned with a separate one of the coin support slots 54, and is biased by a spring 136 into a normal blocking position shown in FIG. 13. In such position, the hook-shaped end portion 122 is positioned in the path of travel of coin slide 16, and the engagement of the hardened inner end projection 72 of cover plate 66 with the shoulder surface 124 of any one of the dogs 120 will stop or prevent further inserted movement of the slide, as shown in FIG. 26, when the slide 16 carries either no coin or an improperly sized coin.

Figure 21:
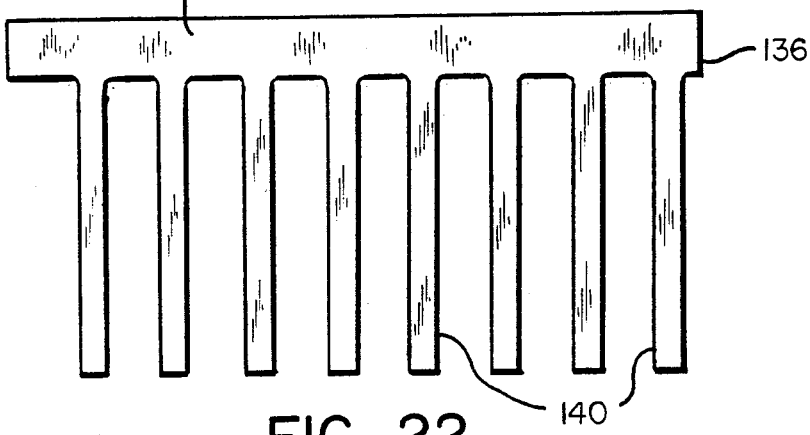
FIG. 21 is a top plan view of the spring member which operatively cooperates with the blocking dogs, and which is shown removed from the coin chute housing.

The spring 136 is shown in FIG. 21 as having a head portion 138 and a plurality of comb-like fingers 140. The spring 136 is positioned, as shown in FIGS. 13–16, with head portion 138 held against the undersurface of housing inner portion 22 by the end portion 126 of the dogs 120. The arrangement is such that each of the spring fingers 140 is aligned with and resiliently engages a separate one of the blocking dogs 120 to bias the set of dogs to their blocking position.

Figures 13, 14, 15, 16:
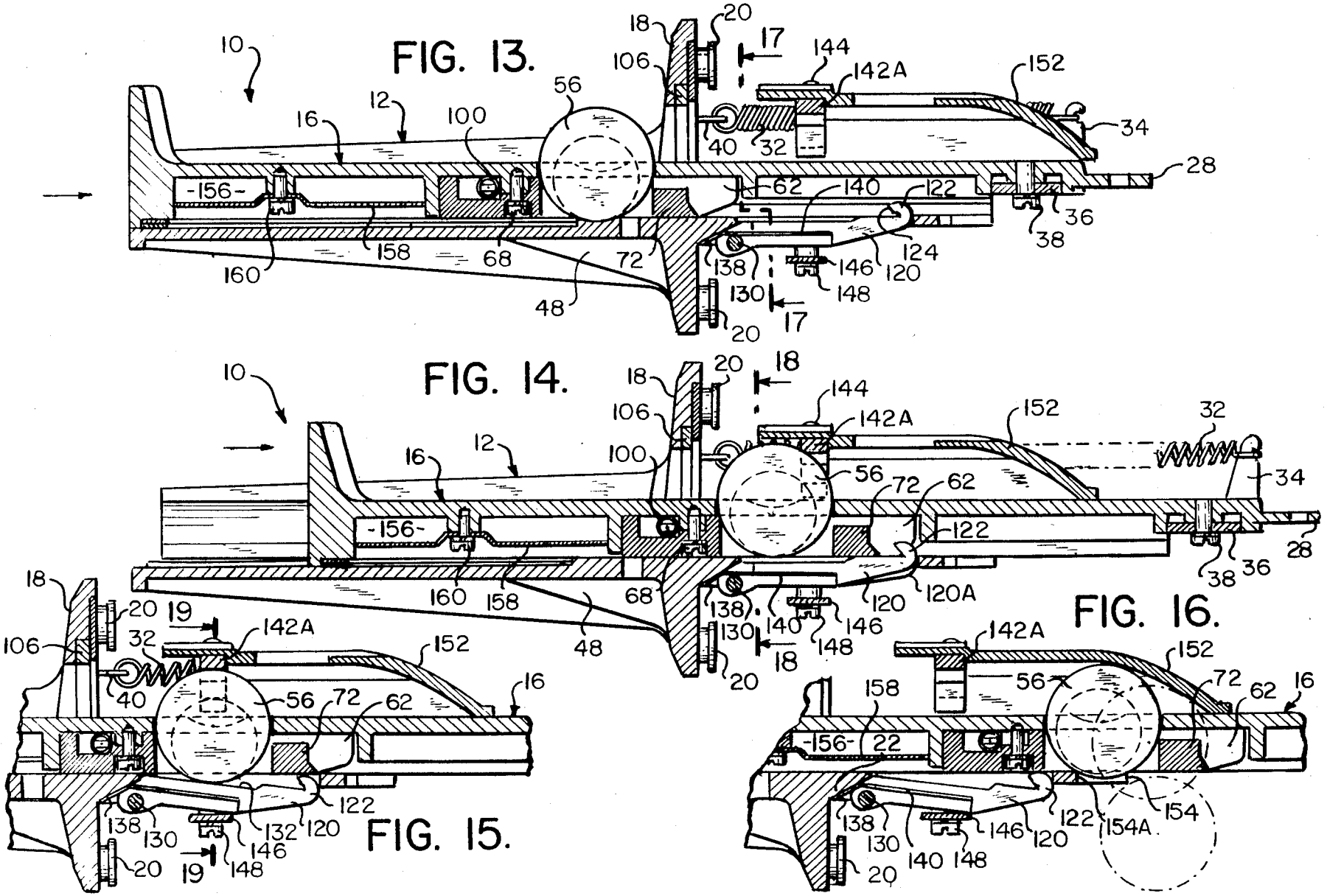
FIG. 13 is a longitudinal sectional view of the coin chute assembly showing the coin slide positioned in the coin chute housing in its retracted coin receiving position, and with a coin received in the coin slide and disposed in a vertical or standing on edge position.
FIG. 14 is a sectional view similar to FIG. 13 with the coin slide advanced inwardly in the direction of its inserted position, and with the coin carried past a gate in the coin chute housing and ready to engage with the coin sizing subassembly.
FIG. 15 is a partial sectional view similar to FIG. 14 with the coin in engagement with the coin sizing subassembly thereby to move the blocking dog to its displaced non-blocking position to permit continued movement of the coin slide to its inwardly inserted position.
FIG. 16 is a partial sectional view similar to FIG. 15 with the coin slide moved further inwardly in the direction of its inserted position, and showing the sequential positioning of the coin as it exits from the coin chute assembly.

The blocking dogs 120 are disposed for movement between the aforesaid normal blocking position and a displaced non-blocking position, as shown in FIGS. 15 and 16, upon inserted movement of coin slide 16 carrying with it properly sized coins 56. In this regard, inserted movement of coin slide 16 causes coins in any of the coin support slots 54 to ride onto the platform 132 of the respective ones of the blocking dogs 120. The manner in which the properly sized coins 56 function to move the associated blocking dogs 120 to their displaced non-blocking position will be hereinafter discussed in connection with the sizing block mechanism of the assembly.

Figure 22:
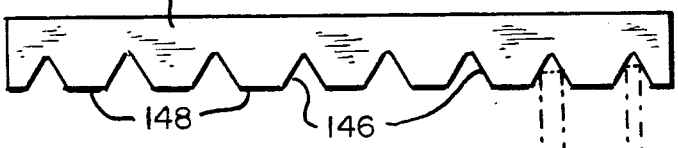
FIG. 22 is a front elevational view of a modified coin sizing block for use in the coin sizing subassembly when the coin slide is disposed to receive only quarters, and showing in phantom line a properly sized coin and an undersized coin in position for gaging the dimensions thereof.

Positioned inward of mounting plate 18 and above guide track 14, is a sizing block 142 mounted to the inner portion 22 of housing 12 by fasteners 144. Sizing block 142 is illustrated in FIG. 22 as having a set of inverted V-shaped notches 146 defining an angle of approximately 60 degrees. As will be appreciated from a further description of the apparatus, each one of the notches 146 is aligned with a respective one of the coin support slots 54 when the coin slide 16 is inserted.

In those applications of use where the assembly is adapted to operated only by quarters, the sizing block 142 will take the form shown in FIG. 22 where the bottom surface 148 of the block lies in a single plane. However, as previously pointed out, the three left-most coin support slots 54 designated by numbers 1 and 2 in FIG. 8 each are capable of receiving adaptors 76 to reduce the size opening thereof to accommodate a dime. Thus, depending on the coin designations selected by the operator, sizing block 142 can take any one of three shapes depending on the combination of coins selected by the operator to operate the mechanism. In those instances where a particular coin support slot 54 is sized to accommodate a dime, the respective notch associated with that slot must extend downwardly into the guide track 14 to a greater extent than those notches associated with the coin slots sized to accommodate quarters. Thus, depending on the sizing block in use, the bottom surface 148 of the block may have segments lying in two different planes.

Figure 19:
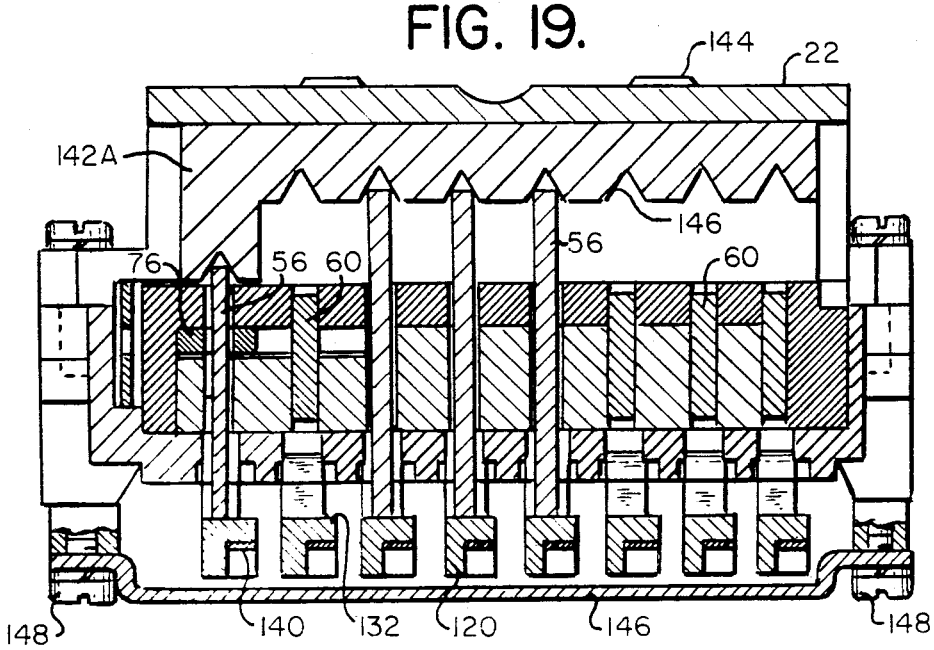
FIG. 19 is a cross-sectional view taken along line 19—19 of FIG. 15.

As previously noted, for purpose of illustration, the coin support slot designated by number 1 in FIG. 8 is sized to accommodate a dime. The sizing block for this combination of coins is shown in FIG. 19 and is designated by number 142A. Furthermore, the coin slots designated by numbers 2,6,7 and 8 are fitted with blanks 58. The mechanism illustrated in the drawings thus is in the configuration to accept three quarters and one dime for a total of 85 cents.

When sizing block 142A is mounted in place, each of the notches 146 also is aligned over a separate one of the blocking dogs 120. The arrangement is such that the distance between any one of the notches 146 and the platform surface 132 of the corresponding one of the blocking dogs 120 is less than the diameter of the coin 56 for which the corresponding one of the coin support slots 54 is sized. It is now apparent that upon inserted movement of coin slide 16 in the direction of the arrow shown in FIGS. 13 and 14, the appropriately sized coins 56 are first carried by the slide past plates 18 and 106, thereby to render the gate defined by said plates in its closed position. The coins 56 then are carried by the slide so as to ride onto the platform 132 of the associated blocking dog 120. As the coins 56 ride onto the respective platforms 132, the upper edge of each coin is received in and engages the associated one of the notches 146 causing the engaged coin to press down against the corresponding one of the blocking dogs 120 thereby to pivot the dog clockwise, as viewed in FIG. 15, and move said dog to its displaced non-blocking position to permit continued movement of coin slide 16 to its fully inserted position. It will further be appreciated that, with reference to FIG. 15, the distance between notch 146 and the platform 132 of the correspond dog 120, when said dog is in its displaced position, is substantially equal to the diameter of the coin 56 for which the corresponding one of the coin support slots 54 is sized.

For those coin support slots 54 fitted with a blank 58, the camming nose portion 62 of the blank is positioned inwardly of the plate projection 72 of slide 16 so as to engage the hook end portion 122 of the associated dog 120 and move the dog to its displaced position out of the path of travel of the slide. For this reason, when viewing FIG. 14, the blocking dog disposed in the path of travel of coin 56 is still shown in its blocking position whereas the dog 120A disposed in the path of travel of the blank 58 already has begun to move to its non-blocking position by reason of engagement with nose portion 62.

The assembly sizes the deposited coins for acceptance or rejection by both diameter and thickness. The relative position of the stationary coin sizing block 142A with respect to platform surface 132 is preset at the factory to such a dimension that, upon inserted movement of coin slide 16 carrying with it appropriately sized coins 56, the hook end portion 122 of dogs 120 are displaced just far enough for the end projection 72 of the slide to clear the hook end portion, thus permitting the slide to continue to its fully inserted position to start the machine or appliance.

Since the distance from the pivot pin 130 to the shoulder 124 of hook end portion 122 is approximately three times greater than the distance from the pivot pin 130 to the point where coin 54 presses down on platform 132 during the sizing operation, the system is relatively sensitive to rejecting slightly undersized slugs or spurious coins. For example, a spurious coin having a dimension 0.020" (0.5 mm) smaller in diameter than that of a properly sized coin will have the differential magnified by an order of three at the point where the slide end projection 72 engages hook end portion 122. That is, a coin that is undersized by 0.020" (0.5 mm) will fail to move the blocking dog 120 sufficiently to clear the end projection 72 of slide 16, and in particular, the distance that blocking dog 120 moves will be approximately 0.060" (1.5 mm) less than that required to clear the end projection of the slide.

In addition, the inverted V-shaped grooves 146 in sizing block 142 function, to some degree, to control the rejection of a spurious coin or slug by gauging its thickness as well. A coin or slug thinner than a proper coin, but having the identical diameter, will be received in a higher position inside the groove. This is illustrated in FIG. 22 where the respective coins are shown in phantom with the thinner coin 56A shown to the right of the properly sized coin 56. The thinner sized coin 56A will not be able to exert sufficient force on platform 132 to move blocking dog 120 to its non-blocking position.

An extra feature of the inverted V-shaped groove 146 is the fact that slugs made from a relatively soft material, such as cardboard, may be rejected, even if these slugs are otherwise sized to the dimensions of a proper coin. For example, referring to FIG. 26, the upward pressure of the spring loaded dog 120 causes the upper edge surface of the slug 150 to be compressed to follow the shape of the V-shaped groove. This, in turn, causes the slug 150 to move in a higher position inside the groove which results in insufficient force being applied to the dog so that it does not move out of its blocking position. As noted in the drawing, the edge projection 72 has engaged hook end portion 122 to prevent further inserted movement of coin slide 16.

In accordance with another feature of the invention, a protective bar 146 extends across the bottom of the blocking dogs 120 and is secured to the undersurface of housing inner portion 22 by fasteners 148. The bar 146 is positioned to lie transversely of the dogs 120 and in the path of movement of the dogs to restrict displaced movement of the dogs beyond their non-blocking position. This serves to prevent distortion of any one of the spring fingers 140 associated with the dogs, as might otherwise occur if any such spring finger was stressed beyond its yield point due to excessive displaced movement of the associated blocking dog 120 significantly beyond its non-blocking position.

Still another feature of the invention provides for the portion of housing 12 located inward of sizing block 142A to curve downwardly to define a baffle 152 positioned above the inner end of guide track 14. Baffle 152 is positioned to engage the edges of coins 56 which are carried by coin slide 16 past the coin sizing mechanism upon inserted movement of the slide, and direct or push the coins down through the respective ones of the coin slots 54 and 70 as the said slots pass the inner end 154 of guide track 14. This is illustrated more clearly in FIG. 16 which shows the sequential positioning of the coin 56 as it exits from the coin chute assembly.

Baffle 152 serves an additional feature in, once again, preventing persons from operating the mechanism while, at the same time, retrieving the coins 56 deposited in coin slots 54. For example, it is known that users try to obtain free use of the apparatus by causing the coins 56 to be taped or wedged in the respective slots 54 so as to be returned to the user upon retracted movement of the coin slide 16. The baffle 152 forces the taped coins 56 to break free of its associated slot 54 upon movement of the slide 16 to its fully inserted position. If the user tries to withdraw the slide 16 prior to its being moved to its fully inserted position, the interengagement of pawl 94 with rack 102 will prevent such retracted movement of the slide. If the user tries to retract the slide 16 after the coins 56 pass the sizing dogs 120, the coins will be in a lower position as shown in FIG. 16 by reason of engagement with baffle 152, and become wedged between the baffle and the inner end 154 of guide track 14 thereby to jam the slide 16 and restrict further retracted movement thereof.

Figure 2:
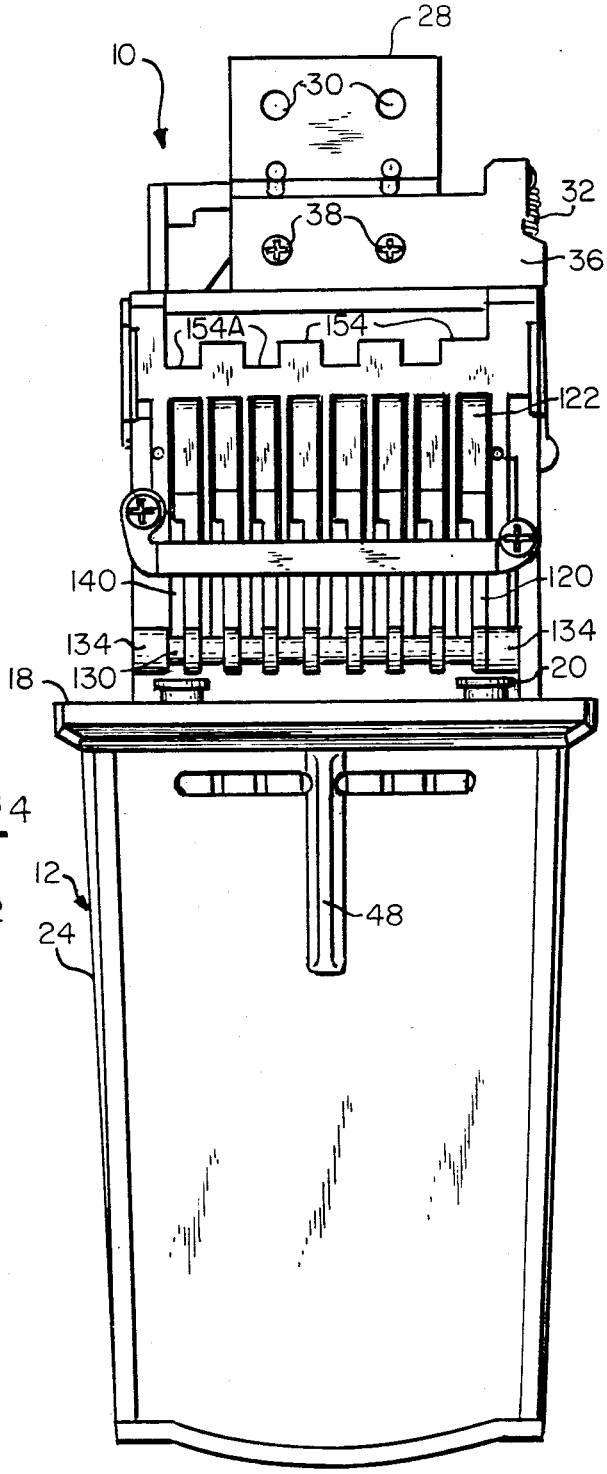
FIG. 2 is a bottom plan view of the coin chute assembly of FIG. 1.
Figure 4:
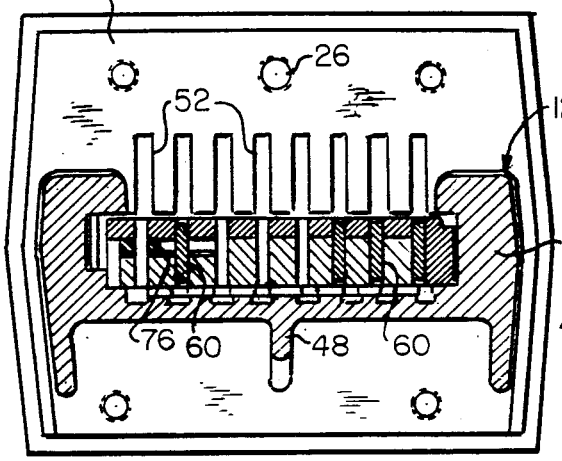
FIG. 4 is a cross-sectional view taken along line 4—4 of FIG. 1.
Figure 3:
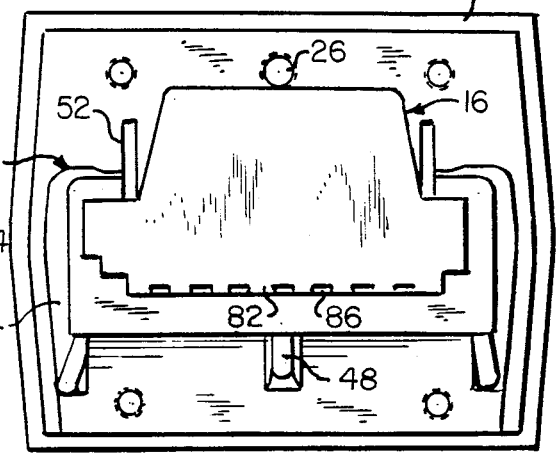
FIG. 3 is a front elevational view of the coin chute assembly of FIG. 1.

Still another feature of the invention provides for the inner end 154 of guide track 14 to be crenulated, as shown in FIG. 2, to permit the coins 56 to pass through the coin slots 56 and 70 in a staggered sequence. This reduces the likelihood of all of the coins arriving at the entrance to the coinbox, or at the funnel (not shown) to said money box, at the same time which possibly could create a jam-up at the entrance of the box.

Since the crenelated edge is formed with recesses 15A, the baffle 152 also must include a plurality of inwardly projecting ribs 155 shown in FIGS. 1 and 5. Each rib 155 is aligned with a separate one of the recesses 154A to insure that the baffle engages all of the coins regardless of their position along the crenelated edge.

Figure 10:
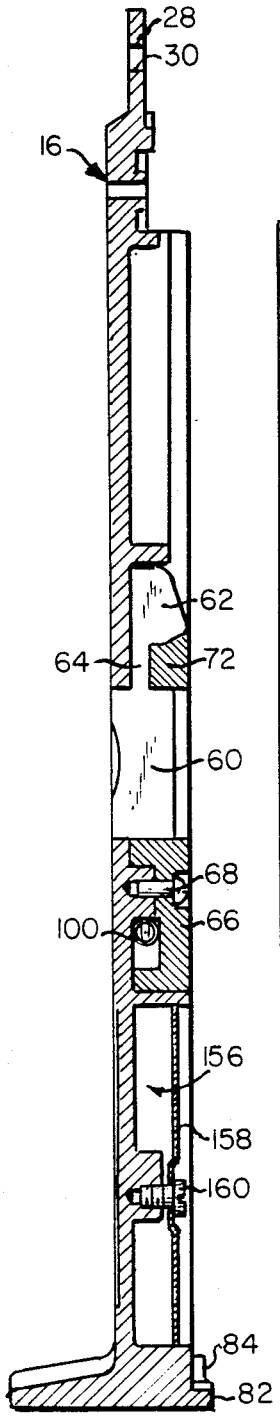
FIG. 10 is a vertical sectional view taken along line 10—10 of FIG. 8, showing a blank insert in a coin seat.

The coin slide 16 also is provided with a storage compartment 156, as shown in FIGS. 9 and 10, for housing spare parts, such as sizing blocks 142, blanks 58 and adaptors 74. Access to the compartment 156 is through a cover plate 158 located on the undersurface of the slide 16, and secured in place by fastener 160.

While the present invention has been described with respect to a particular embodiment, it will be readily appreciated and understood that numerous variations and modifications thereof may be made without departing from the spirit or scope of the claimed invention. For example, while the invention discloses a coin slide capable of accommodating up to eight coins, this number is shown for illustrative purposes only, and the mechanism can be designed to accommodate more than eight coins, if desired. Furthermore, while the disclosure refers to the coins as quarters and dimes, the sizing of the coin support slots and the sizing block can be such as to accommodate other sized coins, and coin combinations. In addition, the angle defined by the inverted V-shaped notches of the sizing block could be other than 60 degrees, preferably in the range of 30 degrees to 90 degrees.

What is claimed is:

1. A coin chute assembly having a housing defining a guide track, and a coin slide reciprocably mounted in said guide track for inserted and retracted movement within said housing, said assembly comprising:

a first inter-engaging set of channels and posts, said posts riding in said channels as said coin slide rides in the guide track of said housing;

a second inter-engaging set of channels and posts positioned inward from said first set of channels and posts, said second set of channels and posts inter-engaging when said coin slide is in its fully inserted position;

a first set of longitudinal rails defining said first set of channels and a second set of longitudinal rails defining said second set of channels, said first and second sets of rails being substantially parallel to one another;

members of said second set of rails being laterally and longitudinally offset from members of said first set of rails;

members of said first set of channels being laterally and longitudinally offset from members of said second set of channels; and members of said first set of posts being laterally and longitudinally offset from members of said second set of posts;

said coin slide having a plurality of coin support slots adapted to hold a coin placed therein in a vertical plane, each of said slots being aligned over one of said first channels;

whereby movement of said coin slide in said guide track from a retracted position to an inserted position causes a coin in any one of said coin slots to first ride in a corresponding one of said first channels and then ride on a corresponding one of said second rails.

2. The coin chute assembly of claim 1 wherein:

said first and second sets of rails extend up from a surface of said guide track;

members of said second set of rails extend longitudinally inward from a lateral plane defined by the inward ends of members of said first set of rails;

said first and second sets of posts extending downward from an under surface of said coin slide, members of said second set of posts being positioned inward from members of said first set of posts on said coin slide.

3. The coin chute assembly of claim 1 wherein:

the upper surface of said first set of rails defines a first plane and the upper surface of said second set of rails defines a second plane, said second plane being above said first plane;

the surface of said first set of posts defining a third plane and the surface of said second set of posts defining a fourth plane, said third plane being below said fourth plane.

4. The coin chute assembly of claim 2 wherein:

the upper surface of said first set of rails defines a first plane and the upper surface of said second set of rails defines a second plane, said second plane being above said first plane;

the surface of said first set of posts defining a third plane and the surface of said second set of posts defining a fourth plane, said third plane being below said fourth plane.

5. The coin chute assembly of claim 1 wherein:

members of said second set of posts ride over respective members of said first set of rails as said coin slide moves within said guide track.

6. The coin chute assembly of claim 4 wherein:

members of said second set of posts ride over respective members of said first set of rails as said coin slide moves within said guide track.

7. The coin chute assembly of claim 1 wherein:

the plane defined by the surfaces of said second set of channels is substantially co-planar with the plane defined by the surfaces of said first set of rails.

8. The coin chute assembly of claim 6 wherein:

the plane defined by the surfaces of said second set of channels is substantially co-planar with the plane defined by the surfaces of said first set of rails.

9. The coin chute assembly of claim 1 wherein:

members of said first set of posts abut against the outer ends of respective members of said second set of rails to determine the fully inserted position of said coin slide in said guide track.

10. The coin chute assembly of claim 8 wherein:

members of said first set of posts abut against the outer ends of respective members of said second set of rails to determine the fully inserted position of said coin slide in said guide track.

11. The coin chute assembly of claim 1 further comprising:

a sizing block positioned above said guide track inward of said second set of rails, said sizing block having a set of inverted notches, each of said notches being aligned with a respective one of said coin support slots when said coin slide is inserted; and a set of blocking dogs along said guide track, each of said blocking dogs being aligned with a separate one of said coin support slots;

each of said blocking dogs being biased into a normal blocking position and being movable between said blocking position and a displaced non-blocking position, any one of said dogs when in said blocking position preventing the full insertion of said coin slide;

inserted movement of said coin slide causing a coin in any one of said coin slots to ride from corresponding ones of said second rails onto corresponding ones of said blocking dogs, members of said set of notches engaging the upper edge of individual appropriate coins positioned in corresponding coin support slots as said coins ride on said blocking dogs causing the coin so engaged to press down against the corresponding one of said blocking dogs to move the dog into a displaced position.

12. The coin chute assembly of claim 11 further comprising:

a spring having a head portion and a set of comb-like fingers extending from said head portion;

said spring being positioned with said head portion engaging said housing and with each of said fingers being aligned with and resiliently engaging a separate one of said blocking dogs to bias said set of blocking dogs to their blocking position.

13. The coin chute assembly of claim 12 further comprising:

a protective bar connected to said housing and extending across said set of blocking dogs;

said bar being positioned in the path of movement of said blocking dogs to restrict further displaced movement of any one of said dogs beyond its non-blocking position to prevent distortion of the respective one of said fingers of said spring associated with said dog.

14. A coin chute assembly having a housing defining a guide track, and a coin slide reciprocally mounted in said guide track for inserted and retracted movement within said housing, said assembly comprising:

a set of coin support slots in said coin slide, each of said slots being adapted to hold a coin placed therein in a vertical plane;

a set of movable blocking dogs pivotally mounted along said guide track of said housing, each of said dogs being spring loaded into a normal blocking position in the path of travel of said coin slide and being movable between said blocking position and a displaced non-blocking position out of path of travel of said coin slide, any one of said dogs when in said blocking position preventing the full insertion of said coin slide;

said spring having a head portion and a set of comb-like fingers extending from said head portion, said spring being positioned with its said head portion engaging said housing and with each of its said fingers being aligned with and resiliently engaging a separate one of said blocking dogs to bias said set of blocking dogs to their blocking position;

each of said blocking dogs being aligned with a separate one of said coin support slots;

inserted movement of said slide in said guide track causing coins in any of said slots to ride on respective ones of said blocking dogs;

a sizing block positioned above said guide track, said sizing block having a plurality of inverted notches, each of said notches being aligned with a separate one of said coin support slots when said coin slide is inserted;

individual ones of said notches engaging the upper edge of individual ones of appropriate coins positioned in said coin support slots as said slide is inserted and forcing the coins so engaged down against the upper surface of individual ones of said blocking dogs to move the corresponding ones of said blocking dogs into said displaced position; and a protective bar connected to said housing and extending across said set of blocking dogs;

said bar being positioned in the path of movement of said blocking dogs to restrict further displaced movement of any one of said dogs beyond its said displaced non-blocking position to prevent distortion of the respective one of said fingers of said spring associated with said dog.

15. The coin chute assembly of claim 14 wherein:

said notches of said sizing block are inverted V-shaped.

16. The coin chute assembly of claims 14 or 15 wherein:

the distance between any one of said notches and the upper surface of the corresponding one of said blocking dogs in the blocking position is less than the diameter of the coin for which the corresponding one of said coin support slots is sized; and the distance between said notch and the corresponding one of said dogs in the said displaced position is substantially equal to the diameter of the coin for which a corresponding one of said slots is sized.

17. The coin chute assembly of claims 14 or 15 further comprising:

a set of blanks, each one of said blanks being sized to fit into one of said coin support slots, each of said blanks having a nose portion, each of said nose portions, when the corresponding one of said blanks is positioned in a coin slot, engaging a corresponding one of said blocking dogs when said coin slide is inserted to move the corresponding one of said dogs from its blocking position to its displaced position.

18. The coin chute assembly of claims 1 or 14 further comprising:

a downwardly curved baffle inward and above the inner end of said guide track and positioned to engage the edges of coins caarried by said coin slide to push said coins down through the respective one of said coin slots as said slots pass the inner end of said guide track.

19. The coin chute assembly of claim 18 wherein:

said inner end of said guide track is crenulated to permit said coins to pass through said coin slots in a staggered sequence.

20. The coin chute assembly of claim 18 wherein:

retracted movement of said coin slide while said baffle engages said coins will wedge said coins between said baffle and said inner end of said guide track to jam said slide and restrict further retracted movement thereof.

21. The coin chute assembly of claims 1 or 14 further comprising:

a first plate positioned above said guide track, said plate having a plurality of open-ended slots disposed vertically in said plate;

each of said slots in said plate being aligned with a separate one of said coin support slots in said coin slide;

a second plate positioned above said guide track, said second plate having a plurality of open-ended slots disposed vertically in said plate;

one of said first and second plates being fixed in place and the other one of said plates being reciprocably mounted for movement laterally of said fixed plate;

said fixed plate and said movable plate together defining a gate having an open position and a closed position;

said movable plate being movable between a first position in which each of the slots thereof is aligned with a separate one of said slots in said fixed plate to define the open position of said gate, and a second position in which each of said slots in said movable plate is laterally offset from the corresponding slot in said fixed plate to define the closed position of said gate;

interengaging camming means on said coin slide and said movable plate for moving said plate to its second position upon inserted movement of said coin slide, and for moving said plate to its first position upon retracted movement of said coin slide;

said gate in its open position permitting an appropriately sized coin positioned in any one of said coin slots to pass through correspondingly aligned slots in said fixed plate and said movable plate upon inserted movement of said coin slide;

said movable plate being moved to its second position after said appropriately sized coin passes through the aligned slots in said fixed plate and said movable plate upon inserted movement of said coin slide to close said gate; and said gate in its closed position preventing passage of a foreign object through any one of said slots in said fixed plate.

22. The coin chute assembly of claim 21 wherein:

said first plate is fixed and said second plate is movable, said second plate disposed for reciprocal movement laterally of the inner surface of said first plate.

23. A coin chute assembly having a housing defining a guide track, and a coin slide reciprocably mounted in said guide track for inserted and retracted movement within said housing, said assembly comprising:

a first inter-engaging set of channels and posts, said posts riding in said channels as said coin slide rides in the guide track of said housing;

a second inter-engaging set of channels and posts positioned inward from said first set of channels and posts, said second set of channels and posts inter-engaging when said coin slide is in its fully inserted position;

a first set of longitudinal rails defining said first set of channels and a second set of longitudinal rails defining said second set of channels, said first and second sets of rails being substantially parallel to one another;

members of said second set of rails being laterally and longitudinally offset from members of said first set of rails;

members of said first set of channels being laterally and longitudinally offset from members of said second set of channels; and members of said first set of posts being laterally and longitudinally offset from members of said second set of posts;

said members of said first set of posts being positioned to abut against the outer ends of respective members of said second set of rails to determine the fully inserted position of said coin slide in said guide track.

* * * * *